US005155527A

United States Patent [19]

Gokita et al.

[11] Patent Number: 5,155,527

[45] Date of Patent: Oct. 13, 1992

[54] CHANGEABLE PROCESS CARTRIDGE USED IN AN IMAGE FORMING APPARATUS HAVING A USEABLE LIFE DETERMINING MEANS

[75] Inventors: Masami Gokita, Tokyo; Goro Oda, Kanagawa, both of Japan

[73] Assignee: Kabushiki Kaisha Toshiba, Kawasaki, Japan

[21] Appl. No.: 661,326

[22] Filed: Feb. 27, 1991

[30] Foreign Application Priority Data

Mar. 22, 1990 [JP] Japan ..... 2-69755

[51] Int. Cl.[5] ..... G03G 21/00

[52] U.S. Cl. ..... 355/204; 355/203; 355/208; 355/209; 355/210; 355/246; 355/308

[58] Field of Search ..... 355/204, 209, 203, 208, 355/210, 211, 212, 245, 246, 260, 308; 346/160

[56] References Cited

U.S. PATENT DOCUMENTS 4,551,000 11/1985 Kanemitsu et al. ..... 355/210
4,771,313 9/1988 Kuroda et al. ..... 355/203
4,894,688 1/1990 Taniguchi et al. ..... 355/244
4,974,020 11/1990 Takamatsu et al. ..... 355/208

FOREIGN PATENT DOCUMENTS 0277071 12/1986 Japan .

*Primary Examiner*—A. T. Grimley
*Assistant Examiner*—J. E. Barlow, Jr.
*Attorney, Agent, or Firm*—Foley & Lardner

[57] ABSTRACT

The end of the operational life of a changeable process cartridge, including a developing device, is determined based on either the average particle size of the toner of a two component developing agent stored in the developing device or the number of printed image forming mediums. The average particle size of the toner of the two component developing agent is estimated from the detection voltage of a toner sensor, which detects the toner density of the two component developing agent stored in the developing device.

11 Claims, 9 Drawing Sheets

CHANGEABLE PROCESS CARTRIDGE USED IN AN IMAGE FORMING APPARATUS HAVING A USEABLE LIFE DETERMINING MEANS

BACKGROUND OF THE INVENTION

1. Field of the Invention

The present invention relates, in general, to an image forming apparatus. In particular, the invention relates to an image forming apparatus which forms a visible image responding to an image information using electrostatic photography technology.

2. Description of the Related Art

In a conventional image forming apparatus which forms an image using electrostatic photography technology, the image information recording surface of a document is scanned by a light beam and the light reflected from the image information recording surface is focused on the outer surface of an image carrier, e.g., a photosensitive drum, to form an electrostatic latent image on the image carrier. The electrostatic latent image formed on the surface of the image carrier is developed by the electrostatic adhesion of a developing agent to be a visible image.

In general, one of two different developing agents is used to develop the electrostatic latent image formed on the image carrier. One developing agent may be a two component developing agent in which thermoplastic colored toner particles are mixed with carrier particles such as ferromagnetic particles. The other may be a single component developing agent in which each toner particle is integrated with a carrier particle.

The two component developing agent has a good environment-resisting ability, e.g., a high image density against high temperature or high humidity. This is because a high electrostatic charge can be produced by the mechanical friction between the toner particles and the carrier particles in spite of high humidity. On the other hand, the one component developing agent has good maintenance ability during the operational life of the image forming apparatus because of the integration of the toner particle and the carrier particle.

However, if the two component developing agent is used, it is necessary to maintain the mixture ratio between the toner particles and the carrier particles (toner density) at a constant value to produce images having a constant image density. Thus, an auto-toner supply system is employed if the two component developing agent is used.

In the auto-toner supply system, a toner sensor is used to detect the toner density of the two component developing agent stored in the developing device. When a low toner density is detected by the toner sensor, the toner is replenished into the developing device.

The toner sensor is disposed in the developing device. When a toner sensing unit of toner sensor contacts the two component developing agent, the toner sensing unit generates an output voltage corresponding to the toner density (toner/carrier ratio) of the two component developing agent.

In the conventional image forming apparatus employing the above-described auto-toner supply system, the toner of the two component developing agent is given a prescribed quantity of electric charge against the electrostatic latent image formed on the surface of the image carrier. The toner of the two component developing agent is attached to the electrostatic latent image on the image carrier, as a toner image, when the electrostatic latent image is developed, and the toner image is transferred to an image forming medium, e.g., a paper, in the transferring process. Thus, the toner in the two component developing agent is consumed every time the developing precess is carried out.

To decrease the consumption of the toner described above, the toner which remains on the image carrier after the transferring process is completed is collected for return to the developing device. Such a toner collecting operation is called a toner recycling system.

In the above-described toner recycling system of the conventional image forming apparatus, if an image having a low image forming rate (area of images formed on the image forming medium/printable area of the image forming medium) is repeatedly printed or copied, untransferred toner particles on the image carrier are collected for the developing device and the collected toner particles are reused repeatedly. If envelopes are used as an image forming medium to be printed by the above-described image forming apparatus, the image forming rate of each envelope is low, e.g., 1~2% (whereas the image forming rate of a paper document is about 5%). This is because, in general, only an address is printed on the envelope. Thus, the above-described toner particles are repeatedly collected and stirred in the developing device, resulting in fine toner particles. Since fine toner particles are gathered to make a mass or group, the volume thereof is increased, although the mass thereof is the same as that in the original state thereof as a whole. Thus, the amount of the two component developing agent which contacts the toner sensing unit is increased and this causes increase in the output of the toner sensing unit. The increase in the output of the toner sensing unit falsely indicates the same result as the decrease of the toner density of the two component developing agent stored in the developing device. Responding to this false result, unused toner is replenished to the developing device and the actual toner density in the developing device becomes excessively high. The background of the image formed on the image forming medium, e.g., a paper, tends to be black, and thus, a fogged image may be formed on the image forming medium.

As described above, if a document having a low image forming rate, such as, e.g., an envelope, is continuously copied by the conventional image forming apparatus, an average toner particle size in the developing device tends to decrease. A particle size of the toner having a diameter of about 11 μm at an initial stage is decreased up to 9 μm (about 20% decrease).

After 15,000 envelopes are copied, the volume of the toner in the developing device is increased in contrast with the decrease in an average particle size of the toner, and thus, the output voltage of the toner sensing unit is increased and unused toner is returned to the developing device. As a result, a fogged image may be formed on the envelope.

In the conventional image forming apparatus, the operational life of a process cartridge including the image carrier (photosensitive drum) and the developing device is determined based on the number of printed or copied image forming mediums. Thus, the process cartridge is not changed to a new one until the number of printed or copied image forming mediums achieves a prescribed value, even if the average particle size of the toner in the developing device has been small.

SUMMARY OF THE INVENTION

Accordingly, it is an object of the present invention to avoid a fogged image formed by an image forming apparatus which employs a toner recycling system.

It is another object of the invention to determine the end of the operational life of an exchangeable process cartridge including an image carrier and a developing device in an image forming apparatus employing a toner recycling system on the basis of changes in the particle size of the toner in the developing device.

To achieve the above-described objects, the image forming apparatus, which employs a toner recycling system wherein the toner remaining on an image carrier in a transfer process is collected and reused in successive developing processes, includes a supply device for supplying an image forming medium, a changeable process cartridge including a developing device in which a two component developing agent having toner and a carrier is stored for forming a visible image on the image forming medium, a toner sensor for outputting a detection voltage signal which is proportional to the average particle size of the toner in the developing device during the operational life of the process cartridge, a control device for determining the end of the operational life of the process cartridge based on the detection voltage signal from the toner sensor.

BRIEF DESCRIPTION OF THE DRAWINGS

These and other objects of the present invention will become more apparent and more readily appreciated from the following detailed description of the presently preferred embodiment of the invention, read in conjunction with the accompanying drawings wherein.

DETAILED DESCRIPTION OF THE PREFERRED EMBODIMENT

Figure 1:
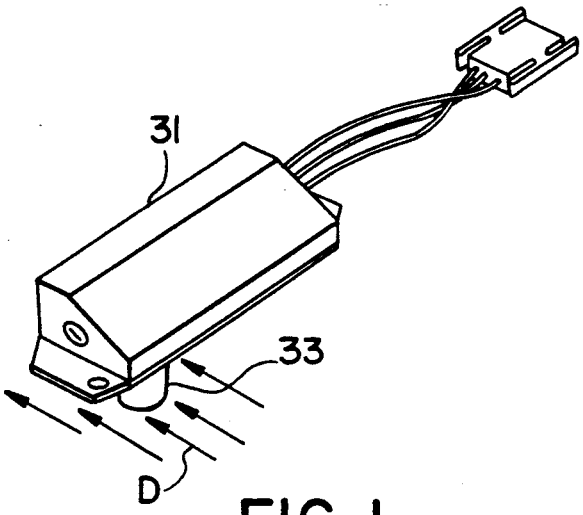
FIG. 1 is a perspective view illustrating a conventional toner sensing unit.

Referring to the accompanying drawings, one embodiment of the present invention will now be described. However, in the drawings, the same numerals used above are applied to similar elements, and therefore the detailed descriptions thereof are not repeated.

An image forming apparatus of one embodiment of the present invention is used as a printer to print an image on an image forming medium, e.g., a paper or an envelope, in accordance with an image signal sent from an external host apparatus, e.g., a computer, a word processing apparatus, etc.

A conventional toner sensor 31 shown in FIG. 1 is disposed in a developing device (described hereafter). When a toner sensing unit 33 of toner sensor 31 contacts the two component developing agent D, toner sensing unit 33 generates an output voltage corresponding to the toner density (toner/carrier ratio) of the two component developing agent D. The following TABLE I shows a relationship between the toner/carrier ratio and the output voltage of toner sensing unit 33.

TABLE I

| | | | |
|---|---|---|---|
| Toner/Carrier ratio (% by wt) | 1.5 | 3.5 (Reference) | 4.5 |
| Output Voltage of toner sensing Unit (V) | greater than 4.5 | 2.5 | 0.4~1.2 |

Figure 2:
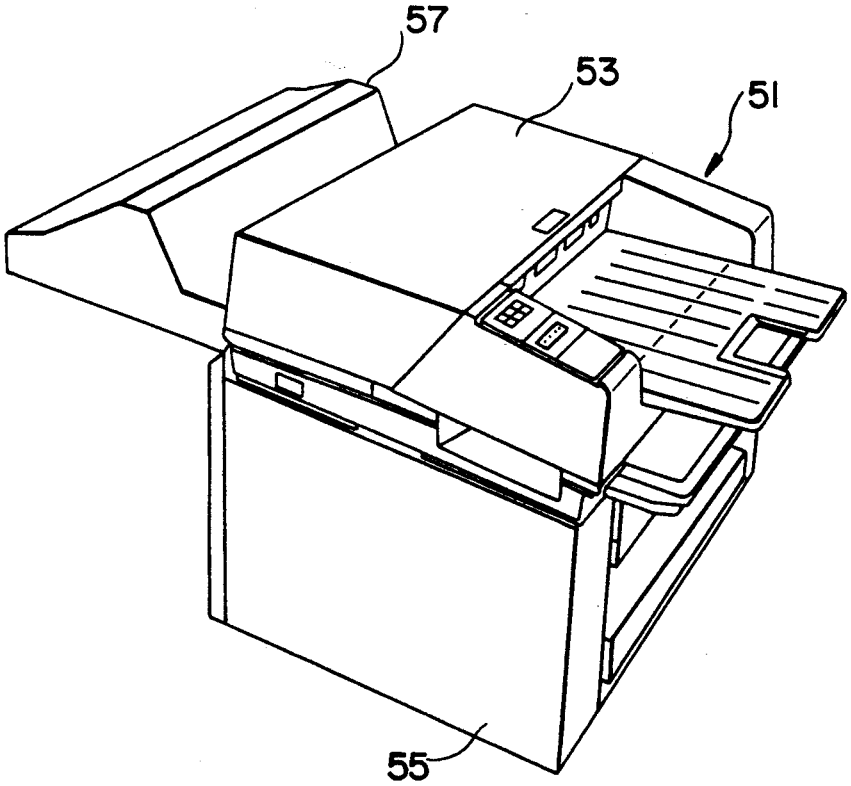
FIG. 2 is a perspective view illustrating an image forming apparatus of one embodiment of the present invention.
Figure 3:
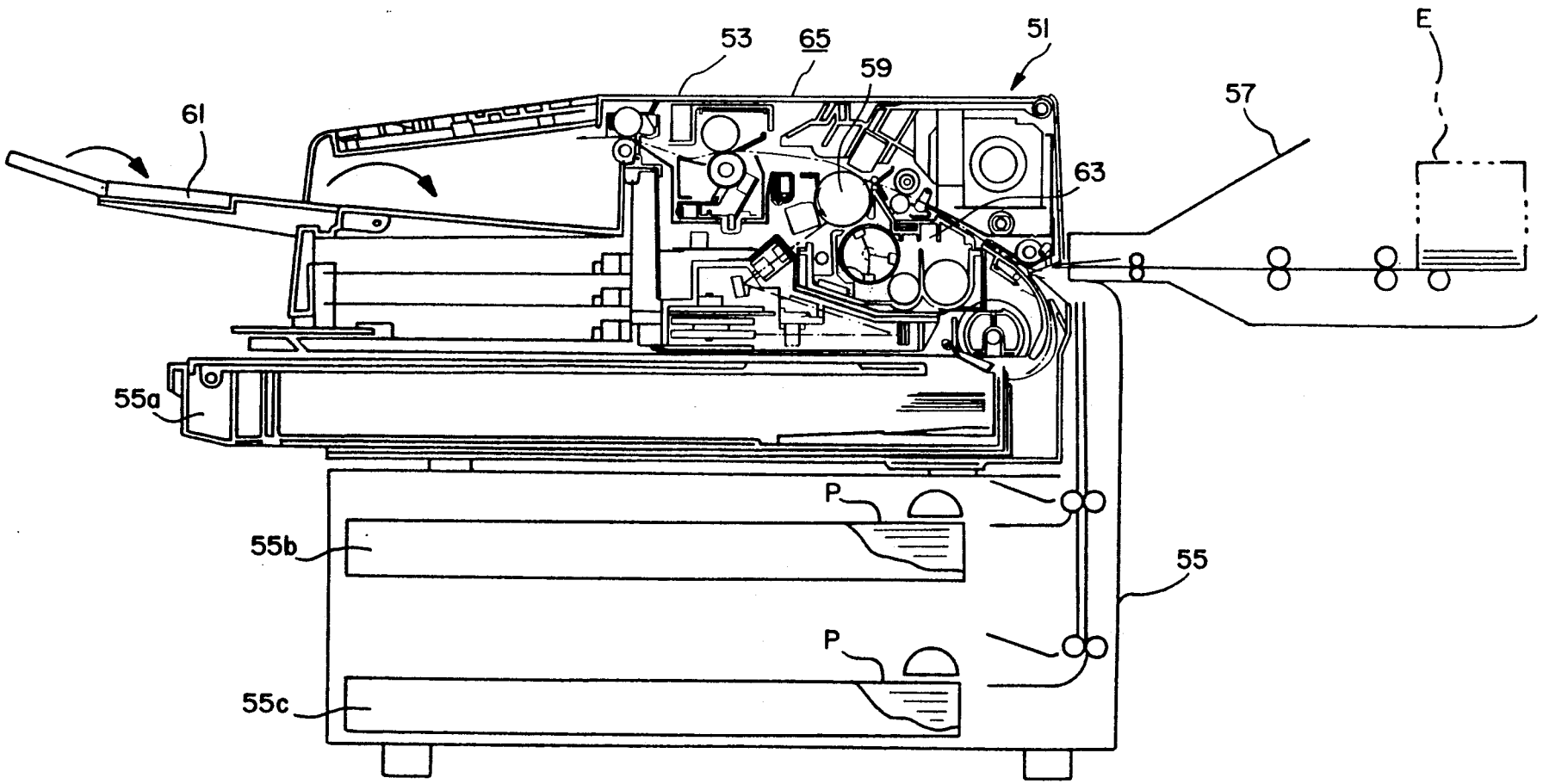
FIG. 3 is a sectional side view illustrating the image forming apparatus shown in FIG. 2.

As shown in FIGS. 2 and 3, an image forming apparatus 51 of this embodiment includes an image forming unit 53, a paper supply unit 55 and an envelope supply unit 57. Image forming unit 53 is mounted on paper supply unit 55. A first paper supply cassette 55*a* is inserted into the lower portion of image forming unit 53, as shown in FIG. 3. Second and third paper supply cassettes 55*b* and 55*c* are arranged in a vertical direction in paper supply unit 55 to selectively supply a different sized paper therefrom. A paper P supplied from one of first, second and third paper supply cassettes 55*a*, 55*b* and 55*c* is fed to the transfer area of a photosensitive drum (image carrier) 59 on which a visible image is formed with a toner. The visible image is transferred to the paper P and the paper P is finally discharged to a tray 61. An envelope E supplied from envelope supply unit 57 is also fed to photosensitive drum 59. The visible image formed on photosensitive drum 59 is transferred to envelope E, and envelope E is finally discharged to tray 61.

In the above-described image forming apparatus 51, a two component developing agent including a toner and a carrier is used to develop the electrostatic latent image formed on photosensitive drum 59. The toner of the two component developing agent is supplied to a developing device 63 arranged in image forming apparatus 51. The carrier of the two component developing agent is provided in developing device 63 beforehand. The toner density of the two component developing agent stored in developing device 63 is controlled within a predetermined range to maintain the image density formed on paper P or envelope E at a constant value. Thus, conventional toner senser 31 shown in FIG. 1 is arranged in developing device 63 to detect changes in the toner density of the two component developing agent stored in developing device 63.

Figure 4:
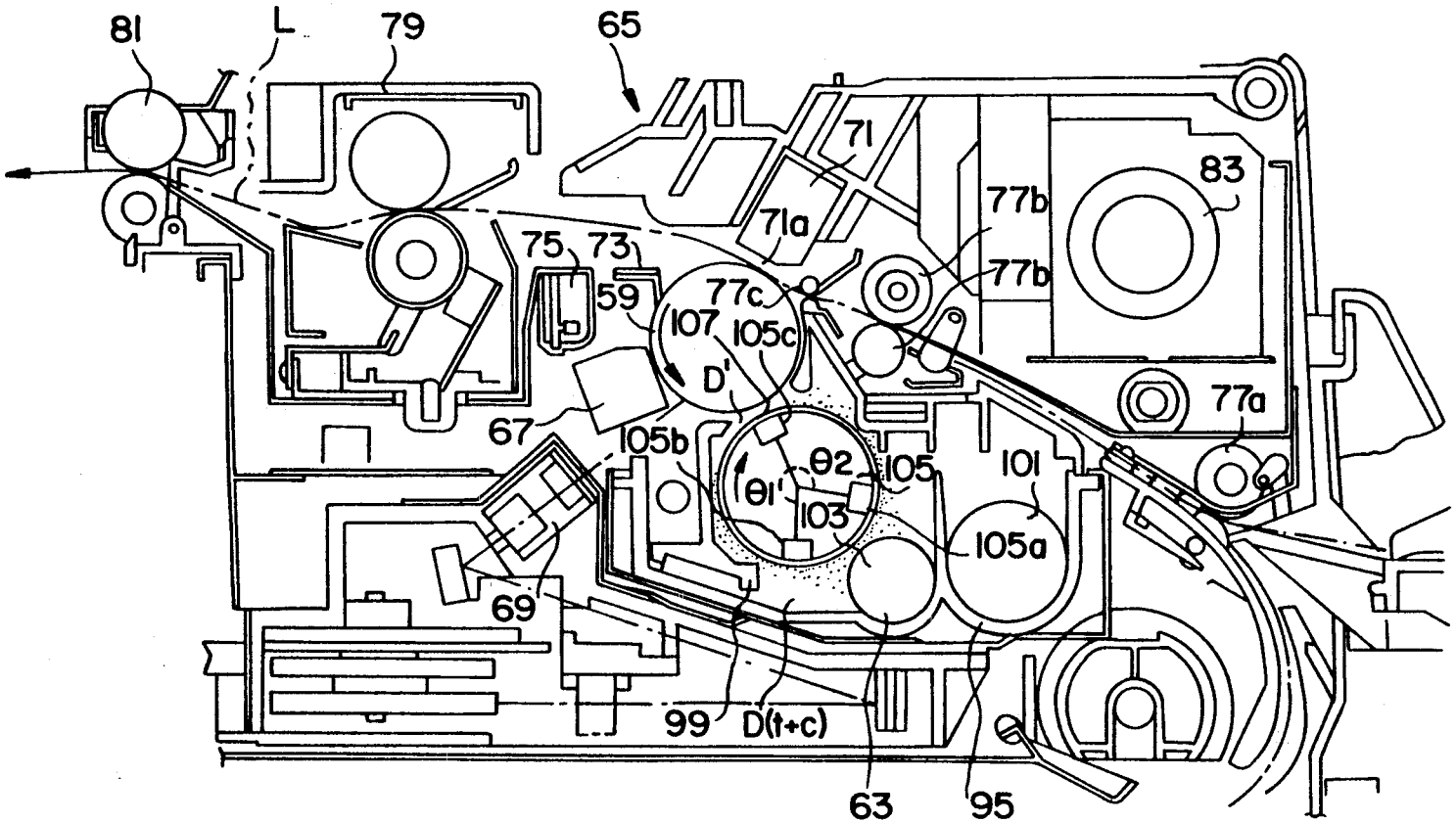
FIG. 4 is an enlarged sectional side view illustrating a process unit of the image forming apparatus shown in FIG. 3.

The construction of a process unit will now be described in more detail with reference to FIG. 4. In a process unit 65, photosensitive drum 59 is disposed at a substantially central portion of process unit 65. Process unit 65 includes a charger 67 for charging the surface of photosensitive drum 59, an illuminating device 69 for forming an electrostatic latent image on photosensitive drum 59 by scanning, and a developing device 63 for developing the latent image, as a visible image, by applying the toner onto photosensitive drum 59. Process unit 65 further includes a transfer charger 71 for transferring the developed image onto paper P or envelope E, taken out from the corresponding units 55 and 57. The above-described devices 67, 69, 63 and 71 are arranged in succession around photosensitive drum 59. A memory erasing device 73 composed of a brush element is disposed between transfer charger 71 and charger 67 for erasing the latent image on photosensitive drum 59, and a pre-illuminating lamp 75 is also disposed between memory erasing device 73 and charger 67.

A paper conveying path L, indicated in a dot and dashed line, is defined from both paper supply unit 55 and envelope supply unit 57 to tray 61 through a space 71*a* (an image transferring space) between photosensitive drum 59 and transfer charger 71.

A pair of conveying rollers 77*a*, a pair of aligning rollers 77*b* and a pair of conveying rollers 77*c* are arranged along paper conveying path L at the paper lead-in side of transfer charger 71. A fixing unit 79 and a paper discharge roller unit 81 are also disposed along paper conveying path L at the paper lead-out side of transfer charger 71, as shown in FIG. 4.

A toner supply cartridge 83 is arranged above the pair of conveying rollers 77*a* to supply toner to developing device 63.

The construction of a process cartridge will be described with reference to FIGS. 5 and 6. A process cartridge 91 includes developing device 63, photosensitive drum 59, charger 61 and memory erasing device 73. Those devices 63, 59, 61 and 73 are assembled as one block, to be easily exchanged for a new one.

Figure 5:
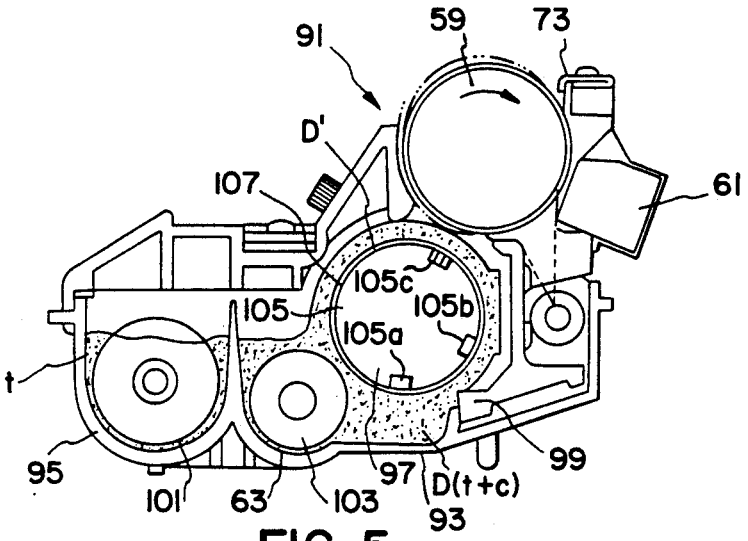
FIG. 5 is an enlarged sectional view illustrating a process cartridge of the process unit shown in FIG. 4.

As shown in FIG. 5, process cartridge 91 includes a casing 93 in which a toner storing section 95 is formed. Developing device 63 is also arranged in casing 93. A developing roller 97 is disposed in developing device 63 to be opposite to photosensitive drum 59. The toner t is stored in toner storing section 95 and the two component developing agent D including the toner t and the carrier c is stored in developing device 63. A doctor blade 99 is arranged in developing device 63 to regulate the thickness of a developing agent magnetic brush D' formed on the circumferential surface of developing roller 97. First and second stirrers 101 and 103 are respectively arranged in toner storing section 95 and developing device 63 to stir the toner t stored in toner storing section 95 and developing device 63.

Developing roller 97 includes a magnetic roll 105 having triple magnetic pole sections 105*a*, 105*b* and 105*c*, and a movable nonmagnetic sleeve 107 enveloping the outer surface of magnetic roll 105. Nonmagnetic sleeve 107 is rotated in a clockwise direction in FIG. 5. One of the triple magnetic pole sections 105*c* opposite to photosensitive drum 59 is an N-pole, and other magnetic pole sections 105*a* and 105*b* are an S-pole. An angle between magnetic pole sections 105*a* and 105*c* at the center of magnetic roll 105 is 150° and an angle between magnetic pole sections 105*b* and 105*c* is 120°. Thus, the latent image formed on photosensitive drum 59 is developed by a voltage difference between the electric charged voltage of photosensitive drum 59 caused by a reverse developing method and the developing bias applied to developing agent magnetic brush D'. At this time, the toner which remains on the surface of photosensitive drum 59 at the last developing process is simultaneously removed and collected by the mechanical scratch force caused by the developing agent magnetic brush D' formed on developing roller 97.

Figure 6:
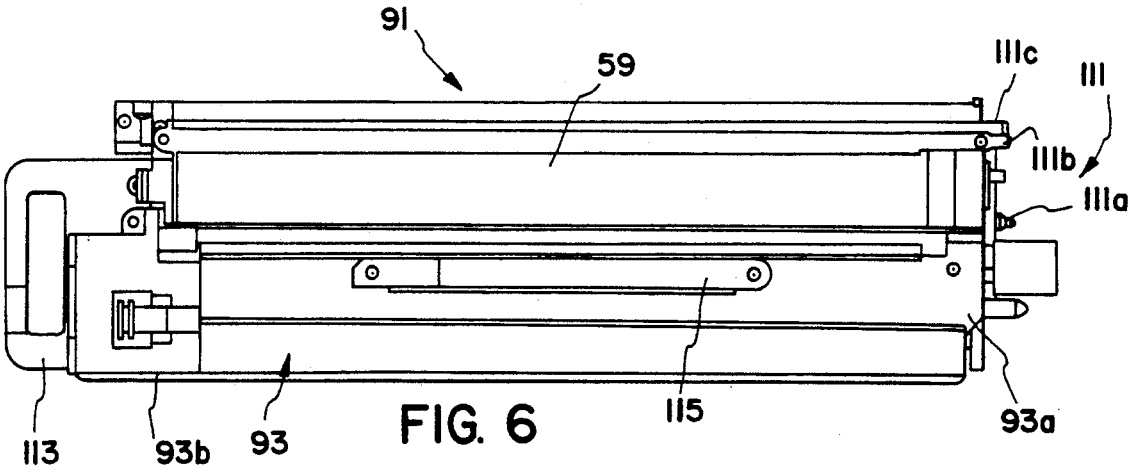
FIG. 6 is an enlarged side view of the process cartridge shown in FIG. 5.

As shown in FIG. 6, a power supply section 111 is formed at one of the opposite ends 93*a* of casing 93. Power supply section 111 includes a first supply 111*a* for supplying power to developing device 63, a second supply 111*b* for supplying power to memory erasing device 73 and a third supply 111*c* for supply power to charger 61. Each supply 111*a*, 111*b* or 111*c* projects from the one of the opposite ends 93*a*. When process cartridge 91 is inserted into a proper position in process unit 65, each supply 111*a*, 111*b* or 111*c* is respectively inserted into the corresponding power supply connectors (not shown) provided in process unit 65.

A handle 113 is formed at the other end 93*b* of casing 93 to easily insert process cartridge 91 into image forming apparatus 51. A retractable handle 115 is also provided to casing 93 of process cartridge 91 to carry process cartridge 91 when process cartridge 91 is taken out from image forming apparatus 51.

Figure 7:
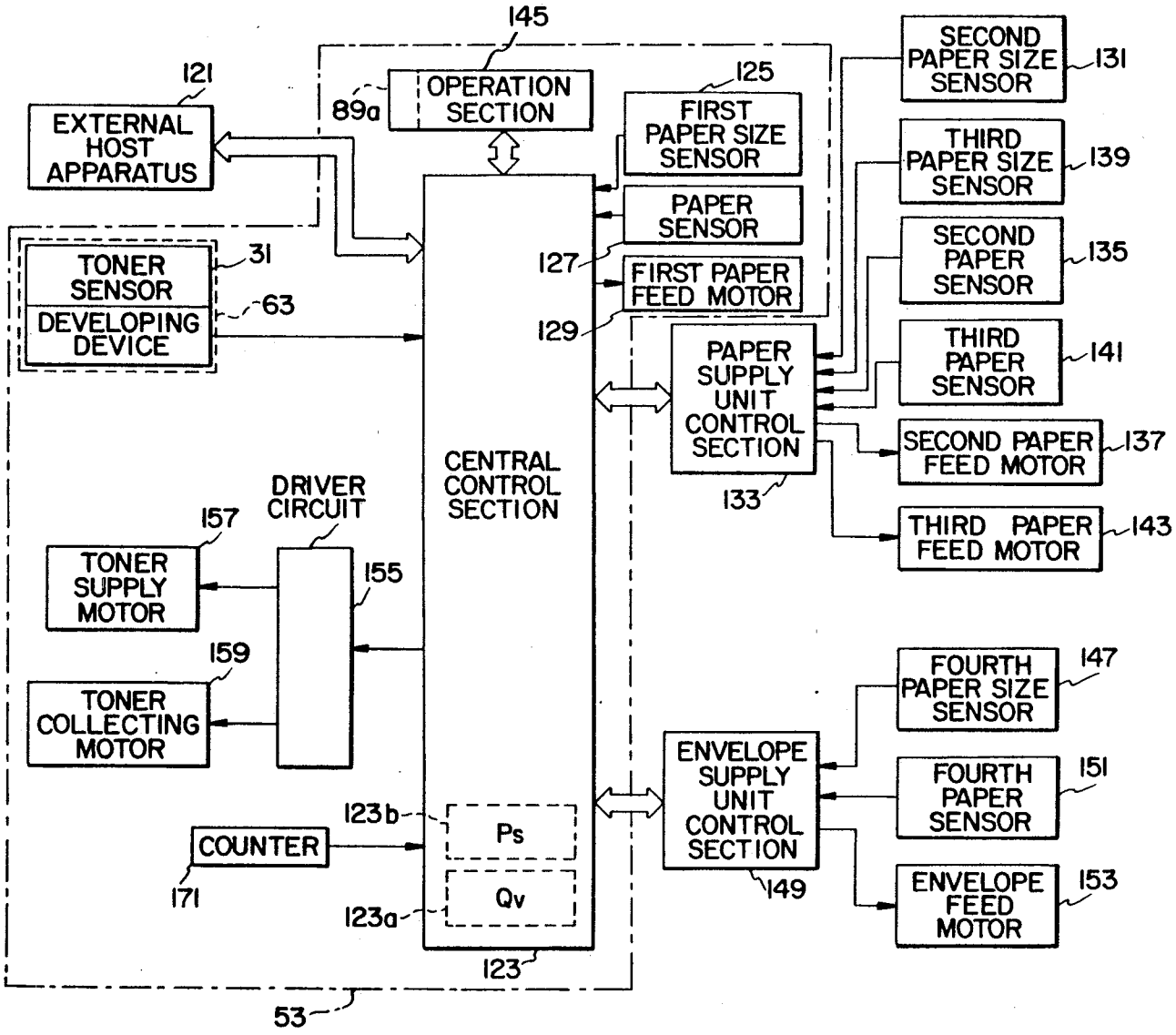
FIG. 7 is a block diagram illustrating an operational construction of the image forming apparatus shown in FIGS. 2 and 3.

As shown in FIG. 7, an external host apparatus 121 outputs a control signal and an image signal to a central control section 123 arranged in image forming unit 53. A detection signal from a first paper size sensor 125 detecting the size of a paper P stored in first paper supply cassette 55*a* is input into central control section 123. A paper sensor 127 detects existence of paper P in first paper supply cassette 55*b* and outputs a detection signal to central control section 123. Based on each detection signal from first paper size sensor 125 and paper sensor 127, central control section 123 controls the operation of a first paper feed motor 129 to feed paper P in first paper supply cassette 55*a* to photosensitive drum 59 when a printing command is output from host apparatus 121 to central control section 123.

A second paper size sensor 131 detects the size of a paper P stored in second paper supply cassette 55*a* and outputs a detection signal to a paper supply unit control section 133. A second paper sensor 135 detects existence of paper P in second paper supply cassette 55*b* and sends a detection signal to paper supply unit control section 133. Based on each detection signal from second paper size sensor 131 and second paper sensor 135, paper supply unit control section 133 controls the operation of a second paper feed motor 137 to take out paper P in second paper supply cassette 55*b*. Since each operation of a third paper size sensor 139 and a third paper sensor 141 is the same as that of second paper size sensor 131 and second paper sensor 135, the operations thereof are not repeated. Based on the detection results of third paper size sensor 139 and third paper sensor 141, a third paper feed motor 143 is controlled by paper supply unit control section 133 to take out paper P in third paper supply cassette 55*c*. Paper supply unit control section 133 also is controlled by central control section 123 on the basis of the operation command from an operation section 145 or external host apparatus 121.

A fourth paper size sensor 147 detects a size of envelope E stored in envelope supply unit 57, and outputs a detection signal to an envelope supply unit control section 149. A fourth paper sensor 151 detects existence of envelope E in envelope supply unit 57, and outputs a detection signal to envelope supply unit control section 149. Based on each detection signal from fourth paper size sensor 147 and fourth paper sensor 151, an envelope feed motor 153 is controlled by envelope supply unit control section 149 to take out envelope E in envelope supply unit 57. Envelope supply unit control section 149 is also controlled by central control section 123 in accordance with the operation command from operation section 145 or external host apparatus 121.

The output signal from toner sensor 31 shown in FIG. 1, indicating the toner density in developing device 63, is fed to central control section 123 through developing device 63. When the toner density in developing device 63 is below a prescribed range, central control section 123 outputs an ON-signal to a driver circuit 155 to energize a toner supply motor 157. Thus, the toner stored in toner supply cartridge 83 shown in FIG. 4 is replenished to developing device 63.

Central control section 123 controls the operation of a toner collecting motor 159 through driver circuit 155 to collect the toner which still remains on the surface of photosensitive drum 59 after the transfer process is executed.

Figure 8:
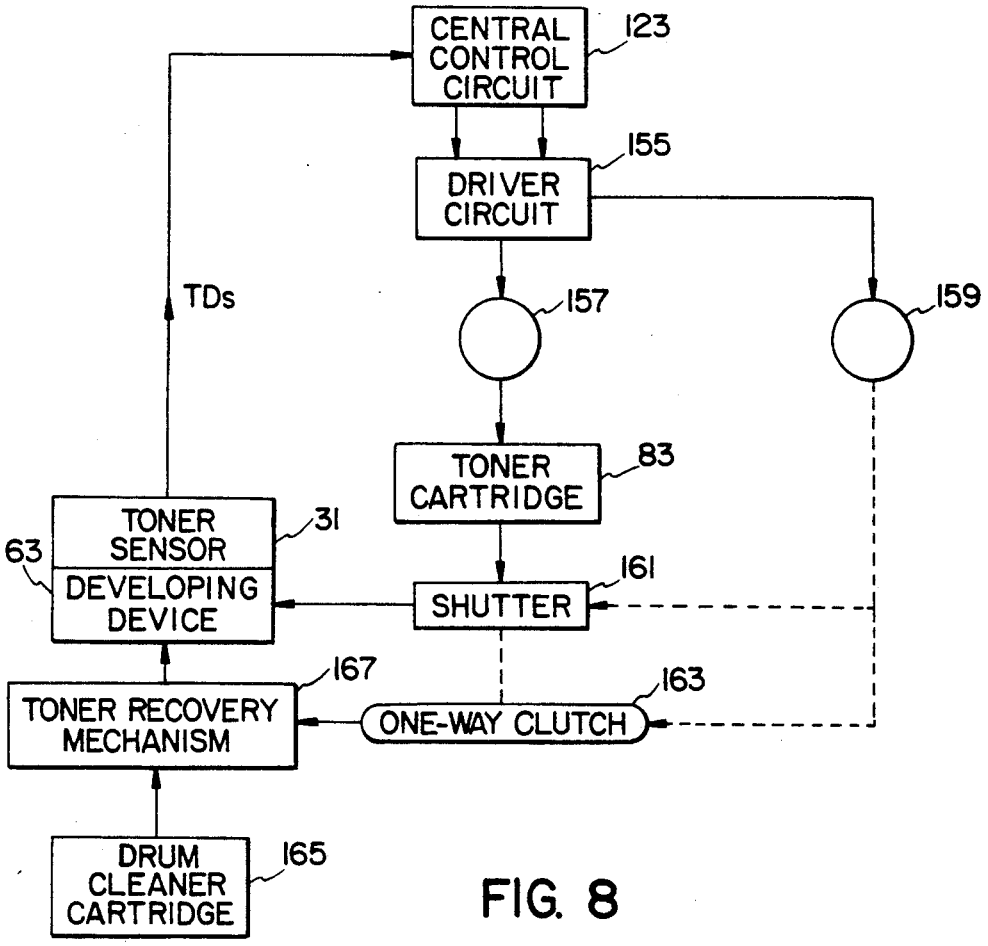
FIG. 8 is a block diagram illustrating the toner density control operation of the image forming apparatus shown in FIGS. 2 and 3.

Central control section 123 has a toner density control function. The toner density control mechanism of image forming apparatus 51 will be described with reference to FIG. 8.

When the output signal TDs corresponding to the toner density in developing device 63 is fed from toner sensor 31 to central control section 123, central control section 123 compares the output signal TDs with a prescribed value, e.g., an initial voltage value of the toner. If the voltage value of the output signal TDs is greater than the prescribed value, the toner density in developing device 63 is determined to be low. Central control section 123 drives toner supply motor 157 through driver circuit 155 to replenish the toner in a toner supply cartridge 83 to developing device 63. A shutter 161 provided between developing device 63 and toner supply cartridge 83 is opened by toner collecting motor 159 during the printing operation. However, shutter 161 is closed by toner collecting motor 159 to prevent the toner in developing device 63 from spilling out of developing device 63 when the user exchanges the empty toner supply cartridge 83 for a new one. Toner collecting motor 159 is also operated to collect the toner on photosensitive drum 59 to developing device 63 after the transfer operation. When toner collecting motor 159 rotates in a clockwise direction, an one-way clutch 163 is rotated to feed the toner collected from photosensitive drum 59 in a drum cleaner cartridge 165 to developing device 31 through a conventional toner recovery mechanism 167.

Figure 9:
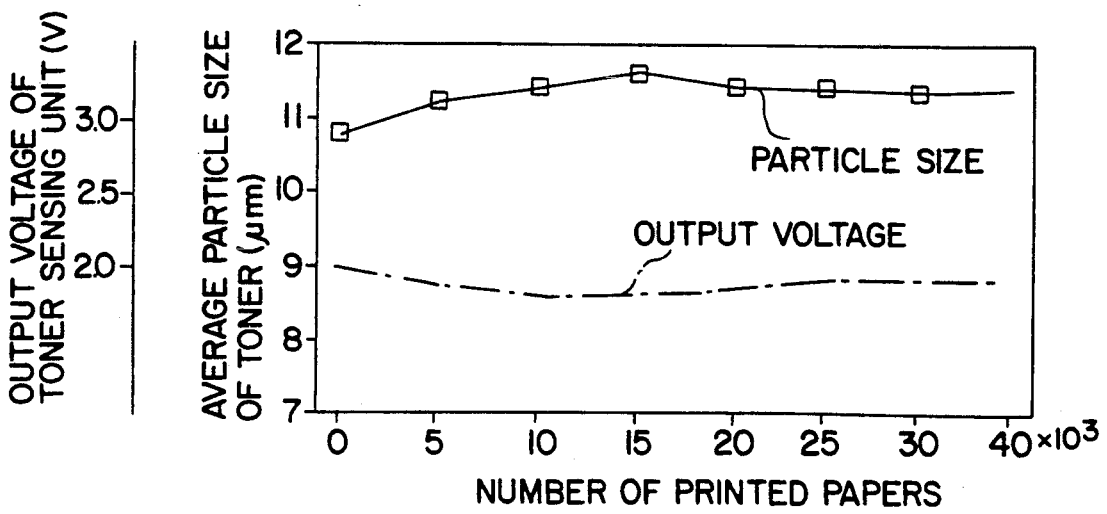
FIG. 9 is a graph showing the relationship between the number of printed papers and the average particle size of the toner in the developing device or the output voltage of the toner sensing unit.
Figure 10:
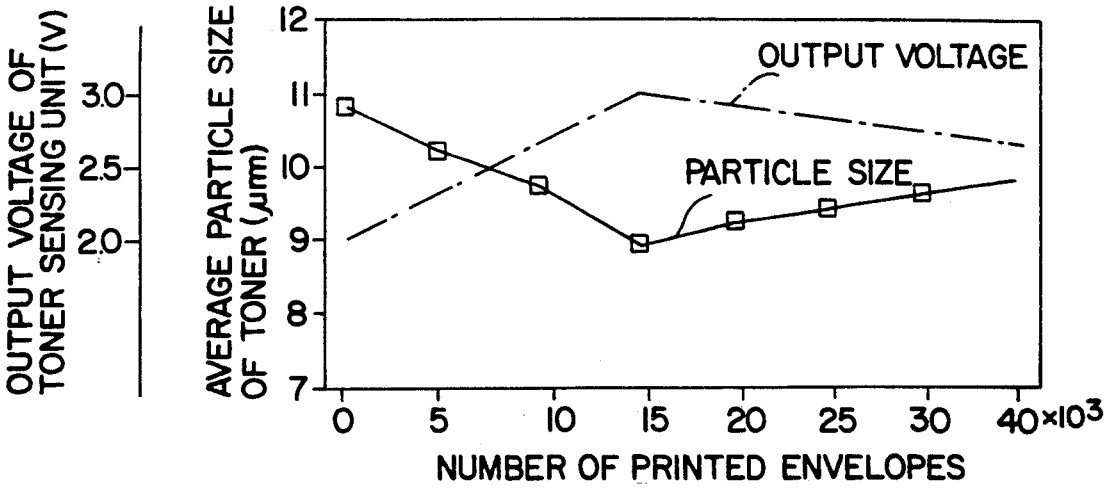
FIG. 10 is a graph showing the relationship between the number of printed envelopes and the average particle size of the toner in the developing device or the output voltage of the toner sensing unit.
Figure 11:
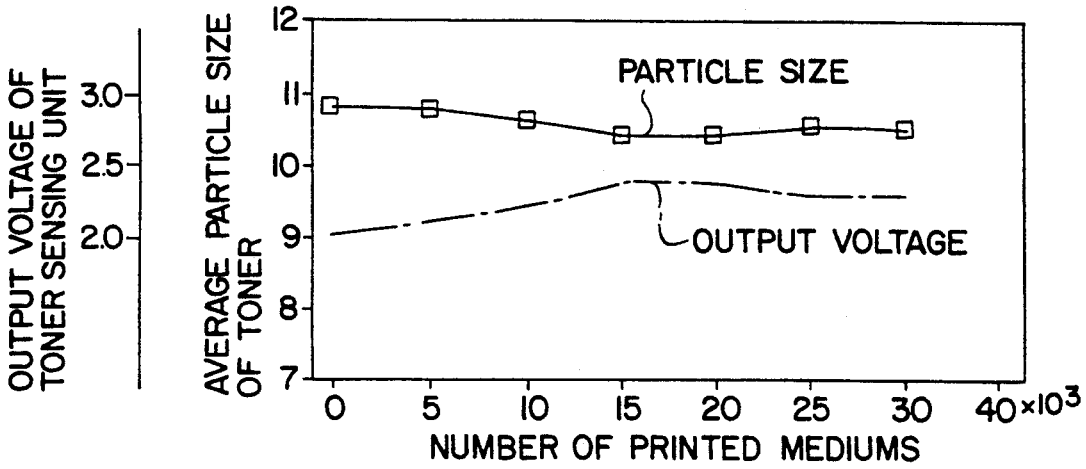
FIG. 11 is a graph showing the relationship between the number of printed papers and envelopes and the average particle size of the toner in the developing device or the output voltage of the toner sensing unit.

As can be seen in FIGS. 9, 10 and 11, the output voltage of toner sensing unit 33 is substantially proportional to the average particle size of the toner stored in developing device 63 during the operational life of process cartridge 91. In FIG. 9, if a paper P is to be printed, the amount of the toner recirculated by the toner recycling system is small and the particle size of the toner in developing device 63 is substantially constant to changes in the number of printed papers. This is because an image forming rate is relatively high when the paper is printed. Thus, a volume of the toner in developing device 63 is substantially constant and the output signal TDs from toner sensing unit 33 of toner sensor 31 is also constant.

However, if an envelope E is to be printed, the amount of the toner remaining on photosensitive drum 59 after the execution of the transfer process is increased because of a low image forming rate, e.g., 1~2% compared with the above-described paper printing. Since such an increased amount of the toner is circulated between photosensitive drum 59 and developing device 63, and is stirred in developing device 63, the particle size of the toner tends to decrease, and the average particle size of the toner in developing device 63 after 15,000 sheets of printing is decreased about 20% of its initial average particle size, as shown in FIG. 10. An initial average particle size of the toner is about 11 μm and an average particle size thereof after 15,000 sheets of printing is about 9 μm. In contrast with the decrease in the average particle size of the toner, the volume of the toner in developing device 63 increases, and the output voltage of toner sensing unit 33 increases, as compared with the initial voltage thereof. As shown in FIG. 10, when the output voltage of toner sensing unit 33 is about 3.0 V, the average particle size of the toner in developing device 63 is about 9 μm. Thus, the estimation of the average particle size of the toner in the developing device 63 is possible in accordance with the output voltage of toner sensing unit 33. If the output voltage of toner sensing unit 33 is about 3.0 V, it is estimated that the average particle size of the toner in developing device 63 is 9 μm. As stated above, if the average particle size of toner in developing device 63 becomes 9 μm, a fogged image may be formed on an image forming medium, e.g., paper P or envelop E.

Figure 14:
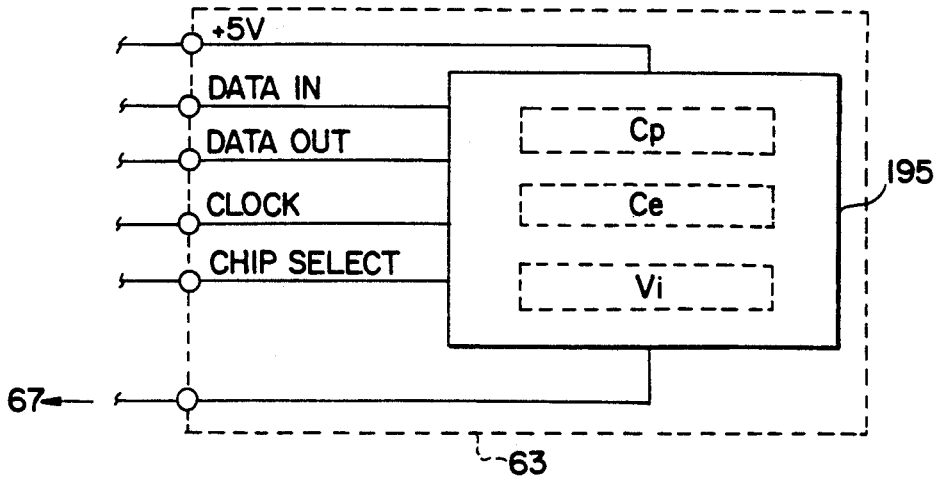
FIG. 14 is an explanatory diagram of the modification of the developing device.

To avoid the formation of such a fogged image, in this embodiment, a prescribed output voltage value Qv of toner sensing unit 33 is stored in a memory **123*a* of central control section 123. A predetermined number of image forming mediums Ps, e.g., 40,000, including printed papers P and envelopes E is also stored in a second memory 123*b* of central control section 123. A counter 171 is provided in image forming apparatus 51, as shown in FIG. 14**, to count a total number of printed image forming mediums Tp.

Figure 12:
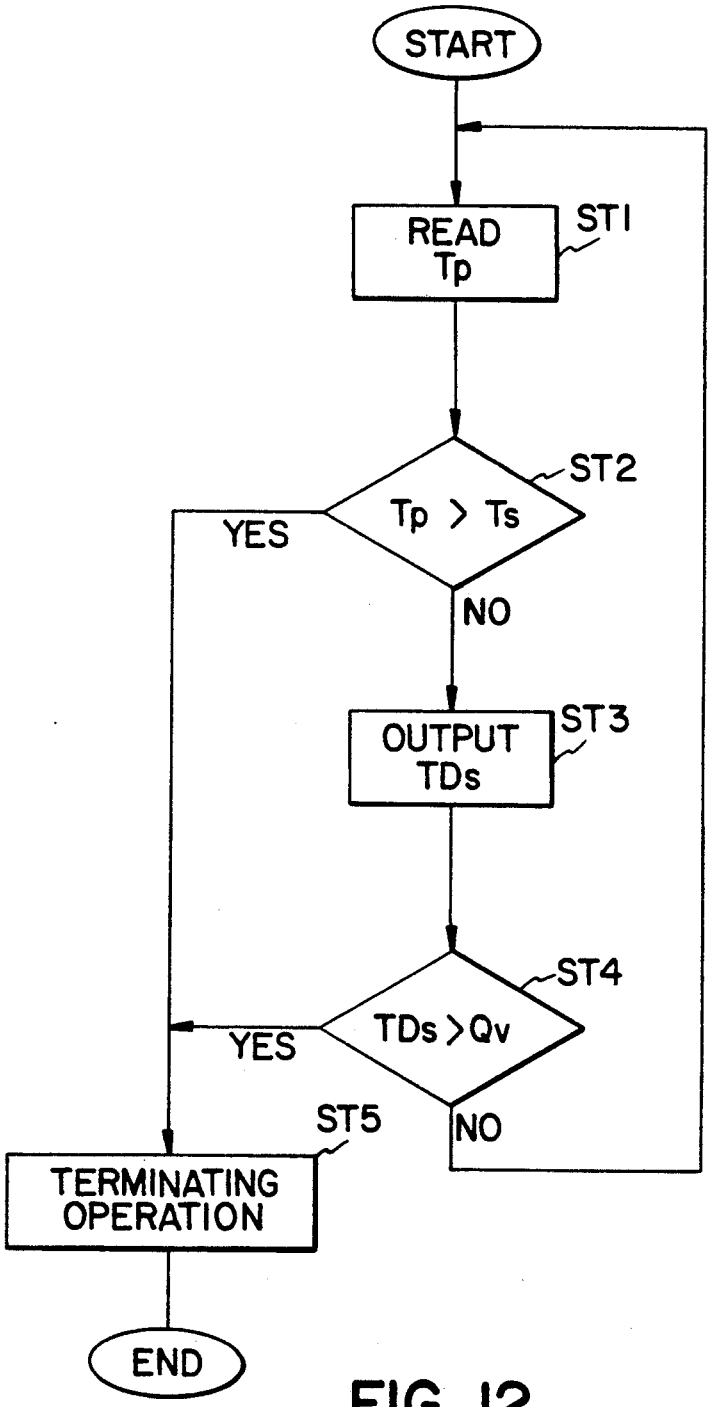
FIG. 12 is a flow chart showing the determination of the operational life end of the process cartridge.

The determination of an operational life end of process cartridge 91 will now be described with reference to FIG. 12. In step ST1, the number of printed image forming mediums Tp is input from counter 171 to central control section 123. The number of printed image forming mediums Tp is compared with the predetermined number of image forming mediums Ps, e.g., 40,000, in step ST2. If the number of printed image forming mediums Tp is greater than the predetermined number of image forming mediums Ps, the YES-path is taken. Otherwise, the NO-path is taken. When the NO-path is taken in step ST2, toner sensing unit 33 outputs detection voltage signal TDs corresponding to the average particle size of toner in developing device 63 in step ST3. The detection voltage signal TDs is compared with the prescribed output voltage value Qv, e.g., 3 V, in step ST4. If the detection voltage signal TDs is greater than the prescribed output voltage value Qv, the YES-path, is taken. Otherwise, the NO-path is taken. When the NO-path is taken in step ST4, central control section 123 estimates that the average particle size of toner in developing device 63 is greater than 9 μm, and the above-described step ST1 is re-executed.

When the YES-path is taken in steps ST2 or ST4, central control section 123 determines that the operational life of process cartridge 91 is ended, and the terminating operation is executed to process cartridge 91 in step ST5.

Figure 13:
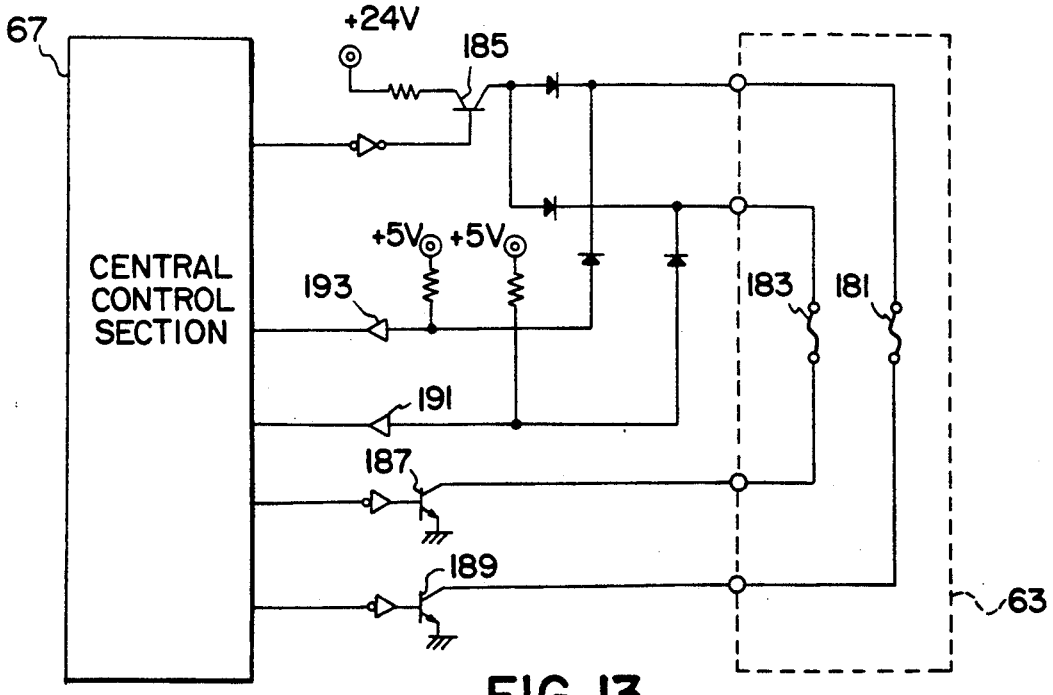
FIG. 13 is a circuitry diagram of the indication of the operational life end of the process cartridge.

The terminating operation of central control section 123 will now be described with reference to FIG. 13. Developing device 63 is provided with a life-termination indicating fuse 181 and an old/new indicating fuse 183. When developing device 63 has not been used, fuses 181 and 183 maintain the conductivity. However, old/now indicating fuse 183 is melted down when developing device is once in use. Life termination indicating fuse 181 is also melted down when the operational life end is determined by central control section 123 (steps ST2 or ST4 in FIG. 12). As shown in FIG. 13, old/new indicating fuse 183 is melted down by rendering transistors 185 and 187 on. Life termination indicating fuse 181 is melted down by rendering transistors 185 and 189 on. Central control section 123 detects whether or not old/new indicating fuse 183 is melted down through transistor 187 and a buffer 191. Central control section 123 also detects through transistor 189 and a buffer 193 whether or not life termination indicating fuse 181 is melted down. Thus, if the conductive state of fuses 181 and 183 is detected, central control section 123 determines that developing device 63 is new and the data Tp (the number of printed image forming mediums) in counter 171 is cleared. If the nonconductive state of only old/new indicating fuse 183 is detected, the data Tp in counter 171 is maintained, and the counting operation of counter 171 is carried out every time the paper P or the envelope E is printed. If nonconductive state of both fuses 181 and 183 is detected, the data Tp in counter 171 is maintained and the printing operation of image forming apparatus 51 is not carried out. Thus, the user may change process cartridge 91 with a new one.

In the above-described embodiment, the prescribed output voltage value Qv is determined as 3 V when the initial output voltage Vi of toner sensing unit 33 is 2 V, as shown in FIGS. 9, 10 and 11. However, the initial output voltage Vi of toner sensing unit 33 tends to be dispersed within a range from 1 V to 3 V in each developing device 63 even if the toner density in each developing device 63 is a constant value, i.e., 3.5%. This is because the toner characteristics of one lot is slightly different from that of other lots. If the initial output voltage Vi of toner sensing unit 33 is one (V), the transition of the output voltage of toner sensing unit 33 against the number of printed image forming mediums is shifted down by one (V). On the other hand, the transistion of the output voltage of toner sensing unit 33 shown in FIGS. 9, 10 and 11 is shifted up a prescribed value (V) if the initial output voltage Vi of toner sensing unit 33 is higher than the prescribed value, as compared with that shown in FIGS. 9, 10 and 11. Therefore, the above-described prescribed output voltage value Qv is modified, based on the initial output voltage vi of toner sensing unit 33.

As shown in FIG. 14, developing device 63 may be provided with a non-volatile memory 195 wherein the data Tp (the number of printed image forming mediums) is stored. The initial output voltage Vi of toner sensing unit 33 is also stored in non-volatile memory 195. Thus, central control section 123 uses data Tp and Vi stored in non-volatile memory 195 of developing device 63 which is presently used. In this case, a plurality of developing devices may be selectively used in parallel.

In the above-described embodiment, the present invention is applied to a printer which prints an image on a paper or an envelope in accordance with the image information from the external apparatus, e.g., a computer, a word processing machine, etc. However, the invention may be applied to a copying machine which copies an image on a document and reproduces the image on a paper or an envelope.

With the present invention, since the average particle size of toner in the developing device is estimated, based on the output voltage of the sensing unit which senses the toner density in the developing device, the termination of the operational life of the process cartridge is determined based on either the estimated average particle size of toner in the developing device or the number of image forming mediums on which an image is formed. A fogged image formed on an image forming medium caused by the decreased average particle size of toner in the developing device can be avoided. In addition, the process cartridge including a photosensitive drum and a developing device may be changed when the average particle size of toner in the developing device is decreased below a prescribed particle size.

The present invention has been described with respect to a specific embodiment. However, other embodiments based on the principles of the present invention should be obvious to those of ordinary skill in the art. Such embodiments are intended to be covered by the claims.

What is claimed is:

1. An image forming apparatus comprising:

means for supplying an image forming medium;

changeable process cartridge means, including an image carrier and a developing device in which a two component developing agent having a toner and a carrier is stored at a prescribed toner density, for forming a visible image on the image forming medium, the toner having a particle size which decreases in a toner recycling operation, wherein the toner remaining on the image carrier in a transfer process is collected and reused in successive developing processes, the cartridge means having a predetermined operational life based on an average particle size of the toner in the developing device and the number of image forming media fed to the image carrier;

toner recycling means for collecting the toner remaining on the image carrier in a transfer process and for supplying the collected toner to the developing device, the particle size of the toner being decreased during the recycling;

counter means for counting the number of image forming mediums which have been supplied to the image carrier;

toner sensor means for outputting a detection voltage signal which has a specific relationship to the toner density of the two component developing agent in the developing device, the detection voltage signal being proportional to the average particle size of the toner in the developing device during the operational life of the process cartridge means; and control means for determining the end of the operational life of the process cartridge means, including, first determination means for determining the end of the operational life of the process cartridge means when the average particle size of the toner in the developing device reaches a prescribed average particle size, and second determination means for determining the end of the operational life of the process cartridge means when the value counted by the counter means achieves a predetermined value before the average particle size of the toner in the developing device reaches a prescribed average particle size.

2. An apparatus according to claim 1 further including means for indicating the end of the operational life of the process cartridge.

3. An apparatus according to claim 2, wherein the control means includes means for activating the indicating means when either the predetermined value of the counter means or the prescribed average particle size of the toner in the developing device is achieved.

4. An apparatus according to claim 1 wherein the process cartridge means includes means for indicating the end of the operational life of the process cartridge.

5. An apparatus according to claim 4, wherein the process cartridge means further includes second means for indicating that the process cartridge means has been used.

6. An apparatus according to claim 5, wherein the control means includes means for activating the second means when the process cartridge means is initially used in the image forming apparatus.

7. An image forming apparatus comprising:

means for supplying an image forming medium;

changeable process cartridge means, including an image carrier and a developing device in which a two component developing agent having a toner and a carrier is stored at a prescribed toner density, for forming a visible image on the image forming medium, the toner having a particle size which is decreased in a toner recycling operation wherein the toner remaining on the image carrier in a transfer process is collected and is reused in successive developing processes, the process cartridge means having a predetermined operational life based on an average particle size of the toner in the developing device and the number of image forming media fed to the image carrier;

toner recycling means for collecting the toner remaining on the image carrier in a transfer process and for supplying the collected toner to the developing device, the particle size of the toner being decreased during the recycling;

toner sensor means for outputting a detection voltage signal which has a specific relationship with the toner density of the two component developing agents in the developing device, the detection voltage signal being proportional to the average particle size of the toner in the developing device during the operational life of the process cartridge means;

control means for determining the end of the operational life of the process cartridge means when the detection voltage signal of the toner sensor means achieves a prescribed voltage indicating a target average particle size of the toner in the developing device; and means for modifying the prescribed voltage value, based on an initial voltage signal output from the toner sensor means when the process cartridge is initially used.

8. An image forming apparatus comprising:

means for supplying an image forming medium including paper sheets and envelopes;

changeable process cartridge means, including an image carrier and a developing device in which a two component developing agent having a toner and a carrier is stored at a prescribed toner density, for forming a visible image on the image forming medium, the toner having a particle size which decreases in a toner recycling operation wherein the toner remaining on the image carrier in a transfer process is collected and reused in successive developing processes, the process cartridge means having a predetermined operational life based on an average particle size of the toner in the developing device and the number of image forming media fed to the image carrier;

toner recycling means for collecting the toner remaining on the image carrier in a transfer process and for supplying the collected toner to the developing device, the particle size of the toner being decreased during the recycling;

counter means for counting the number of image forming mediums which have been supplied to the image carrier;

first memory means for storing the number of paper sheets fed to the image carrier;

second memory means for storing the number of envelopes fed to the image carrier;

toner sensor means for outputting a detection voltage signal which has a specific relationship with the toner density of the two component developing agent in the developing device, the detection voltage signal being proportional to the average particle size of the toner in the developing device during the operational life of the process cartridge means; and control means for determining the end of the operational life of the process cartridge means based on the detection voltage signal from the toner sensor means.

9. An apparatus according to claim 8, wherein the process cartridge means includes third memory means for storing an initial voltage of the toner sensor means when the process cartridge means is initially used in the image forming apparatus.

10. An apparatus according to claim 9, wherein the control means includes sub means for determining the end of the operational life of the process cartridge means when the detection voltage signal of the toner sensor means achieves a prescribed voltage value indicating a target average particle size of the toner in the developing device.

11. An apparatus according to claim 10, wherein the control means includes means for modifying the prescribed voltage value based on the initial voltage of the toner sensor means in the third memory means when the process cartridge means is initially used.

* * * * *